US006067956A

United States Patent [19]

Motose et al.

[11] Patent Number: 6,067,956

[45] Date of Patent: May 30, 2000

[54] KNOCK CONTROL FOR ENGINE

[75] Inventors: Hitoshi Motose; Masahiko Kato, both of Hamamatsu, Japan

[73] Assignee: Sanshin Kogyo Kabushiki Kaisha, Hamamatsu, Japan

[21] Appl. No.: 09/211,782

[22] Filed: Dec. 15, 1998

[30] Foreign Application Priority Data

Dec. 18, 1997 [JP] Japan ..... 9-349481

[51] Int. Cl.[7] ..... F02D 41/40

[52] U.S. Cl. ..... 123/305; 123/406.47

[58] Field of Search ..... 123/305, 682, 123/406.47, 406.5, 406.51, 406.45, 406.46, 672

[56] References Cited

U.S. PATENT DOCUMENTS 4,986,245 1/1991 Nakaniwa et al. ..... 123/406.47
5,630,395 5/1997 Katoh et al. ..... 123/406.47
5,640,939 6/1997 Shimada et al. ..... 123/406.47
5,673,667 10/1997 Nakamura ..... 123/425
5,694,909 12/1997 Kato ..... 123/672
5,775,311 7/1998 Kato et al. ..... 123/681
5,816,218 10/1998 Motose ..... 123/479
5,918,584 7/1999 Kato ..... 123/681

*Primary Examiner*—Willis R. Wolfe
*Assistant Examiner*—Hieu T. Vo
*Attorney, Agent, or Firm*—Knobbe, Martens, Olosn & Bear LLP

[57] ABSTRACT

A feed back control system and method for direct injected engines, particularly useful in marine applications to avoid knocking. Different types of injection control are applied to achieve this depending on the engine running condition when knocking occurs. Both injection initiation and duration are controlled. Injection timing is employed primarily to control knocking under steady state running. Both injection initiation and duration are controlled to avoid knocking under acceleration.

22 Claims, 7 Drawing Sheets

KNOCK CONTROL FOR ENGINE

BACKGROUND OF THE INVENTION

This invention relates to an engine control and more particularly to an improved engine knock control for a direct injected, internal combustion engine.

In spite of the advantages of two cycle engines over four cycle engines in regard to complexity and high specific output, the environmental concerns are causing reappraisal of the continued use of two cycle engines. Specifically, the overlap between the scavenge port and exhaust port opening and closing gives rise to the possibility that unburned hydrocarbons may pass into the atmosphere through the exhaust port.

It has been thought that the performance of these engines can be improved by utilizing such methodologies as feedback control and/or direct cylinder fuel injection in order to improve their performance and make their continued use more feasible.

With feedback control systems, an engine combustion condition sensor such as an oxygen sensor is positioned in proximity to the combustion chamber or the exhaust system so as to sense the oxygen content of the exhaust gases at the completion of the burning cycle. By determining the amount of oxygen present, it is possible to tell if the engine is running rich or lean. Then, feedback control is possible to maintain the desired fuel/air ratio and, accordingly, improve the exhaust emission control.

Direct cylinder injection also is useful in improving engine performance. With direct cylinder injection, the amount of fuel injected per cycle can be more accurately controlled and this is particularly important with two cycle engines.

However, when two-cycle engines employ fuel injection and the fuel is injected directly into the combustion chamber, the risk of having the fuel pass out of the exhaust port is substantially increased. Therefore, there has been proposed in our copending application entitled "Control for Direct Injected Two-Cycle Engine," Ser. No. 09/188,953, filed Nov. 10, 1998, and assigned to the Assignee hereof, an injection system wherein the timing of fuel injection is controlled so as to be more advanced from the prior art methods so that it occurs before the exhaust port has been totally closed.

The injection timing is initiated, however, at a time so that the first injected fuel will not reach the exhaust port before it closes. This system provides a significantly improved engine performance and emission control.

The system described in our aforenoted copending application provides very good basic engine control for the engine and particularly for a direct injected engine having feedback control. However, there are some conditions when other types of control may be desirable to improve engine performance.

For example, there may be a condition arise which is commonly referred to as "knocking." Actually, knocking can result under two different types of running conditions. One of these is during an extreme acceleration and the other is when operating at a steady state condition but wherein the load on the engine may change and require some form of knock control.

If feedback control is utilized when these conditions arise, then the knock control must be done by a means such as adjusting engine timing or some other expedient, which may not always be the most effective or the most desirable.

It is, therefore, a principal object of this invention to provide an improved fuel injection control from an internal combustion engine having direct cylinder injection that incorporates manipulation of the fuel injection control so as to provide knock control.

It is a further object of this invention to provide an improved knock system and arrangement for a direct injected internal combustion engine.

As has been noted, engine knocking can arise under some different circumstances. It has been discovered in connection with this invention that the type of fuel injection control in order to improve knock under these running conditions may be different.

It is, therefore, a still further object of this invention to provide an improved fuel injection control for an internal combustion engine wherein the type of fuel injection control applied depends upon the running condition under which the knocking occurs.

SUMMARY OF THE INVENTION

This invention is adapted to be embodied in a direct cylinder injected internal combustion engine comprised of an engine body defining at least one cylinder bore in which a piston reciprocates. A cylinder head is affixed to one end of the engine body for closing the cylinder bore and defining with the piston and the cylinder bore a combustion chamber. At least one intake port admits an air charge to the combustion chamber. At least one exhaust port discharges burned combustion products from the combustion chamber. A fuel injector sprays fuel directly into the combustion chamber for combustion therein.

In accordance with a first feature of the invention, a control system and method is provided for a direct injected two-cycle internal combustion engine wherein the ports are opened and closed by the reciprocation of the piston. The fuel injection control is such that fuel injected by the fuel injector is injected at a time before the exhaust port has closed but terminates sufficiently before exhaust port closing so as to ensure that fuel will not pass directly out of the exhaust port. In addition, a knock sensor is provided and the fuel injection control is effected so as to reduce the knocking tendency when a knocking condition arises.

In accordance with a method and apparatus for performing another feature of the invention, the engine is provided with a knock sensor. A control for the fuel injector controls the initiation of injection of fuel into the combustion chamber and the duration of fuel injection. If a knocking condition is sensed, the control determines what the engine operating condition is when the knocking condition arises. A type of fuel injection control is modified in response to the sensed knocking condition and the operating condition under which it occurs so as to control knock differently depending upon different engine operating conditions.

DETAILED DESCRIPTION OF THE PREFERRED EMBODIMENTS OF THE INVENTION

Figure 1:
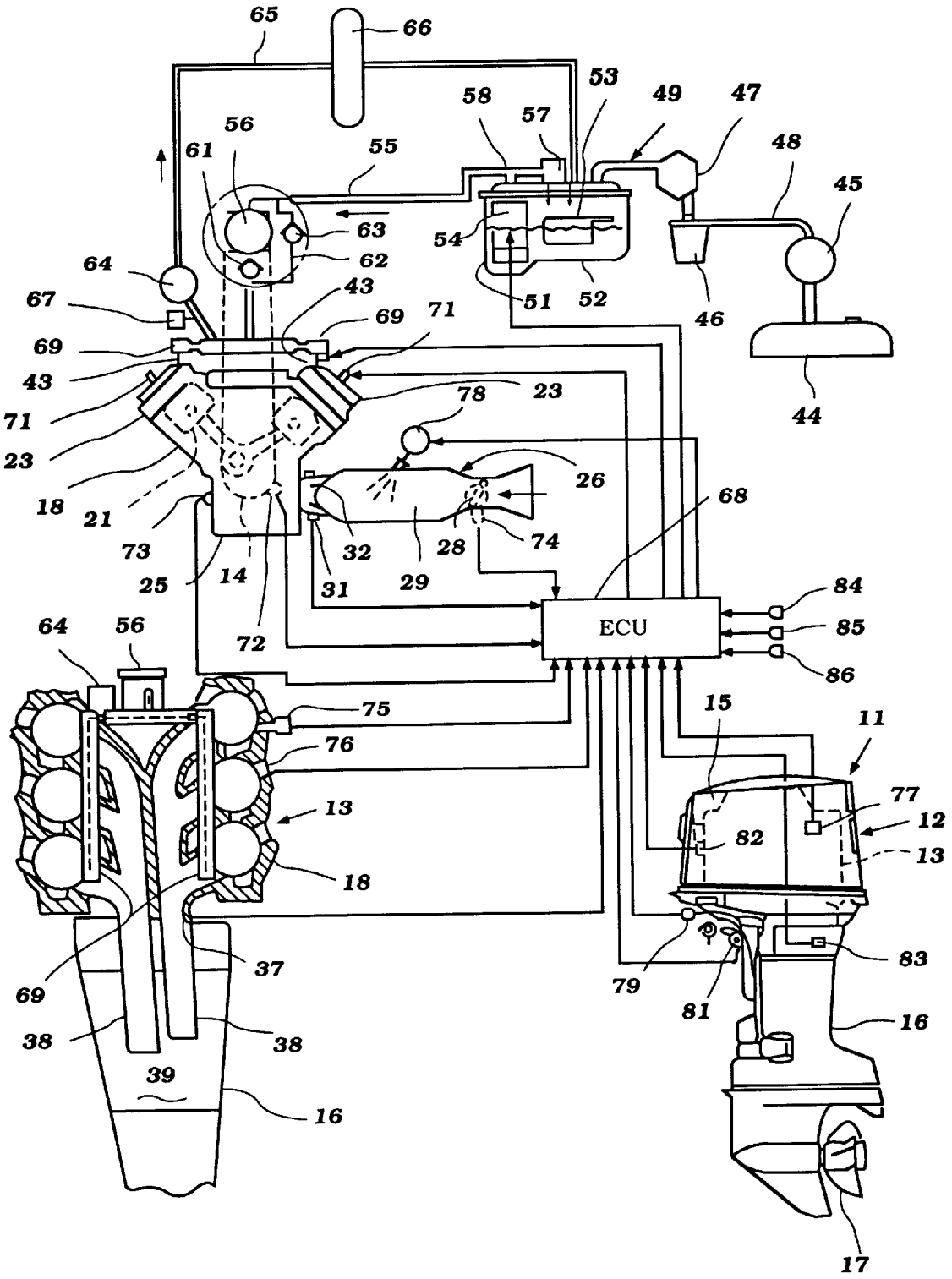
FIG. 1 is a partially schematic view having three portions that are connected by the controlling ECU of the engine. The lower right hand portion of this view shows a side elevational view of an outboard motor, the lower left hand side shows a rear elevational view of the outboard motor on an enlarged scale and a partial cross-section of the engine taken through the cylinders and exhaust manifold and the upper portion shows a top plan view of the engine and the fuel supply system with portions shown schematically.

Referring initially primarily to FIG. 1, the lower right hand portion of this view illustrates a side elevational of an outboard motor that is constructed and operated in accordance with the invention. The outboard motor is indicated generally by the reference numeral 11 and except as will hereinafter be noted maybe considered to be of a generally conventional construction.

Figure 12:
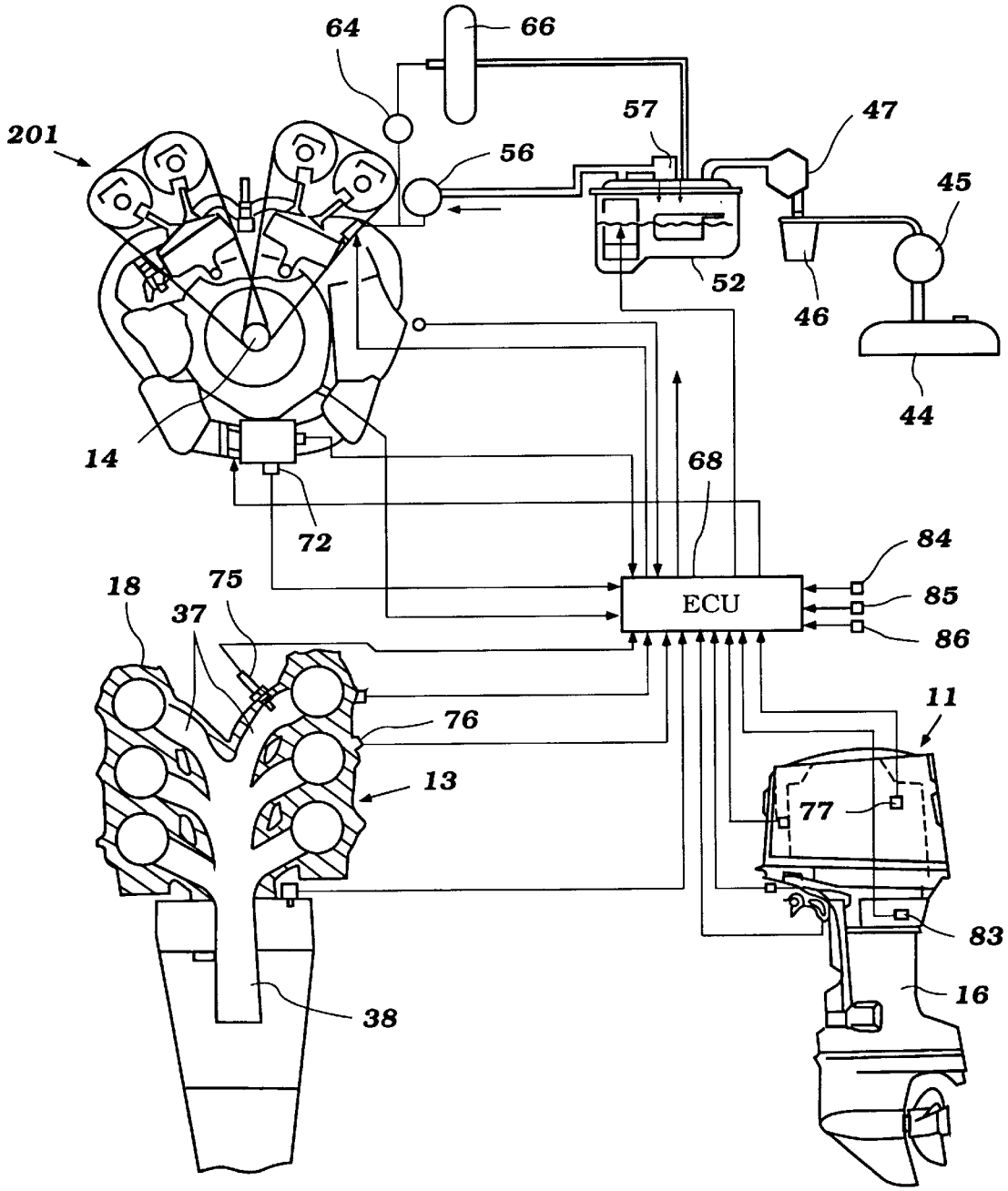
FIG. 12 is a view in part similar to FIG. 1 having the same three-part views but showing how the invention can be employed in conjunction with a four-cycle engine.

The outboard motor 11 is comprised of a power head 12 that contains a powering internal combustion engine 13. As best seen in the other two portions of this figure, the engine 13 is, in this embodiment, of the V6 type and operates on a two stroke crankcase compression principal. Although the number of cylinders and cylinder orientation can be varied, the invention has particularly utility in connection with two cycle engines and particularly those having multiple cylinders but certain of the control strategy also is applicable to four cycle engines. Such an embodiment is shown in FIG. 12.

As is typical with outboard motor practice, the engine 13 is supported in the power head 12 so that its crankshaft 14 rotates about a vertically extending axis for a reason which will be described momentarily.

The power head 12 is completed by a protective cowling 15 which surrounds and protects the engine 13. This protective cowling 15 is formed with an air inlet opening so that induction air for operation for the engine 13 can be drawn from the surrounding atmosphere.

The engine 13 and specifically its crankshaft 14 is coupled to a driveshaft (not shown) that depends into and is journaled within a driveshaft housing lower unit assembly 16. This is the reason for the vertical orientation of the axis of rotation of the crankshaft 14. This driveshaft depends into the lower unit where it drives a propulsion device for an associated watercraft through a suitable transmission. In the illustrated embodiment, the propulsion device comprises a propeller 17 which is selectively driven in forward and reversed directions through a bevel gear reversing transmission of the type well known in this art.

The outboard motor 11 also includes clamping and swivel brackets or another arrangement for mounting it to the transom of an associated watercraft. Since these types of constructions are well known in the art, further description of them is not believed to be necessary to permit those skilled in the art to practice the invention. The mounting arrangement is such, however, that the height and trim angle of the propeller 17 may be adjusted, even during running. This is significant in the engine control, as will become apparent.

Figure 2:
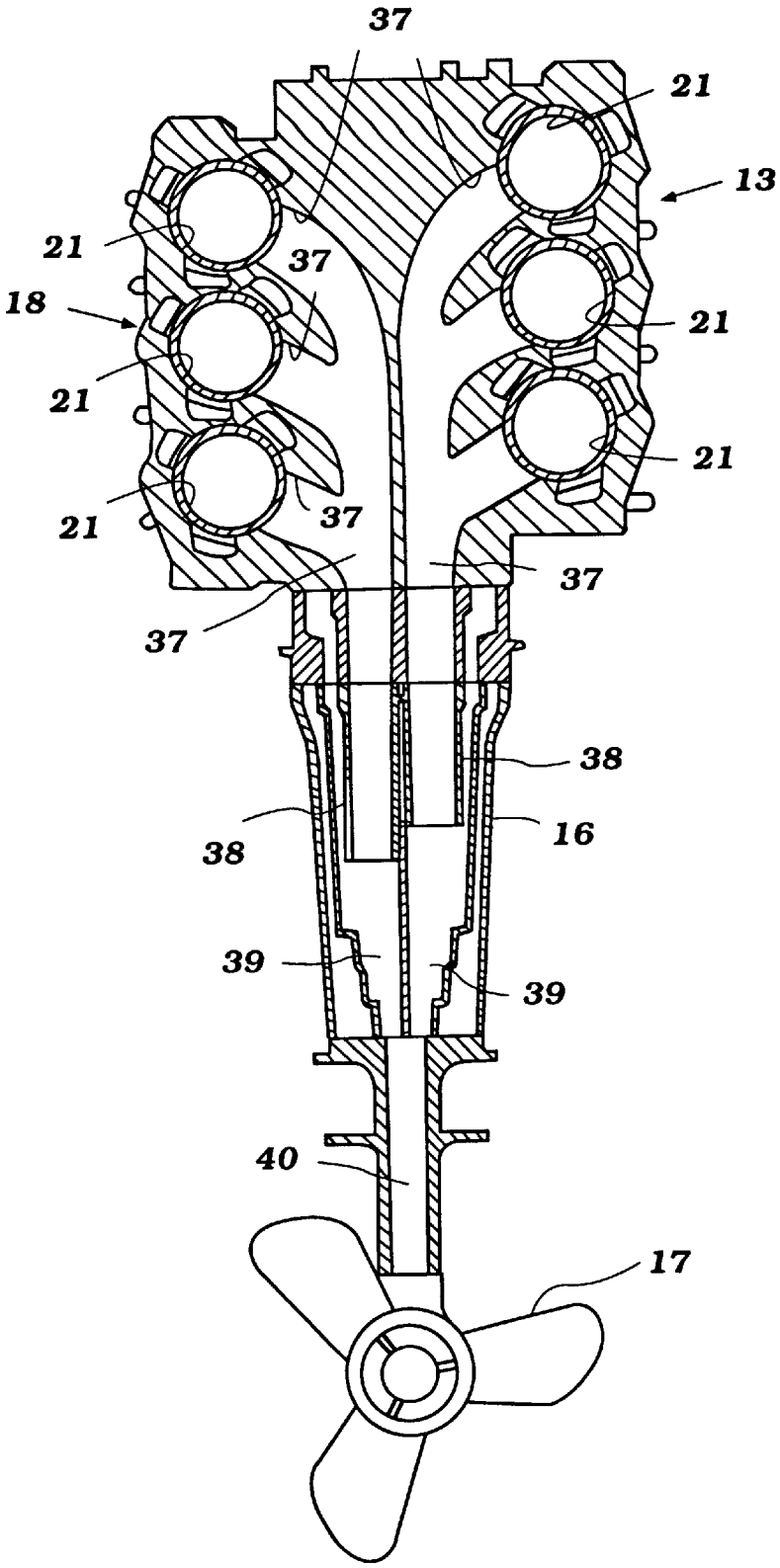
FIG. 2 is an enlarged and more complete view of the outboard motor as shown in the lower left hand view of FIG. 1.

Referring now primarily to the lower left hand view and the upper view of FIG. 1 and additionally to FIG. 2, the engine 13 includes a cylinder block, indicated generally by the reference numeral 18. Because of the V-type configuration employed in this embodiment, the cylinder block 18 is formed with two cylinder banks each of which has three vertically spaced cylinder bores 19. Pistons 21 are slidably supported in the cylinder bores 19. The pistons 21 are connected by means of connecting rods 22 to the throws of the crankshaft 14 for driving it in a known manner.

Cylinder head assemblies, indicated generally by the reference numeral 23 are affixed to the banks of the cylinder block 18 and close the cylinder bores 21. These cylinder head assemblies 22, the cylinder bores 19 and the pistons 21 form the combustion chambers of the engine 13.

The crankshaft 14 rotates in a crankcase chamber defined by the cylinder block 18 and a crankcase member 24 that is affixed thereto. As is typical with two cycle crankcase compression engines, the portions of the crankcase chamber, indicated schematically at 25, associated with each of the cylinder bores 19 are sealed from each other.

An air charge is delivered to these individual crankcase chamber sections 25 by an air induction system which appears also in the upper portion of FIG. 1 and which is indicated generally by the reference numeral 26. This induction system 26 includes an air inlet device 27 that may include a silencing arrangement and which draws air from within the protective cowling 15 that has been admitted through the aforenoted inlet opening.

A throttle valve 28 is provided in throttle bodies that communicate with the intake device 27 and deliver it to intake manifold runners 29 of an intake manifold assembly. The throttle valves 28 are controlled in any suitable manner to satisfy the operator demand. The intake manifold runners 29 communicate with intake ports 31 formed in the crankcase member 24 and each associated with a respective cylinder bore 19.

Reed type check valves 32 are provided in the manifold runners 29 adjacent the intake ports 31. These reed type check valves permit an air charge to be drawn into the crankcase chambers when the respective pistons 21 are moving upwardly in their cylinder bores 19. As the pistons 21 move downwardly, the charge in the crankcase chambers 25 will be compressed and the respective reed type check valve 32 will close to preclude reverse flow.

Figure 3:
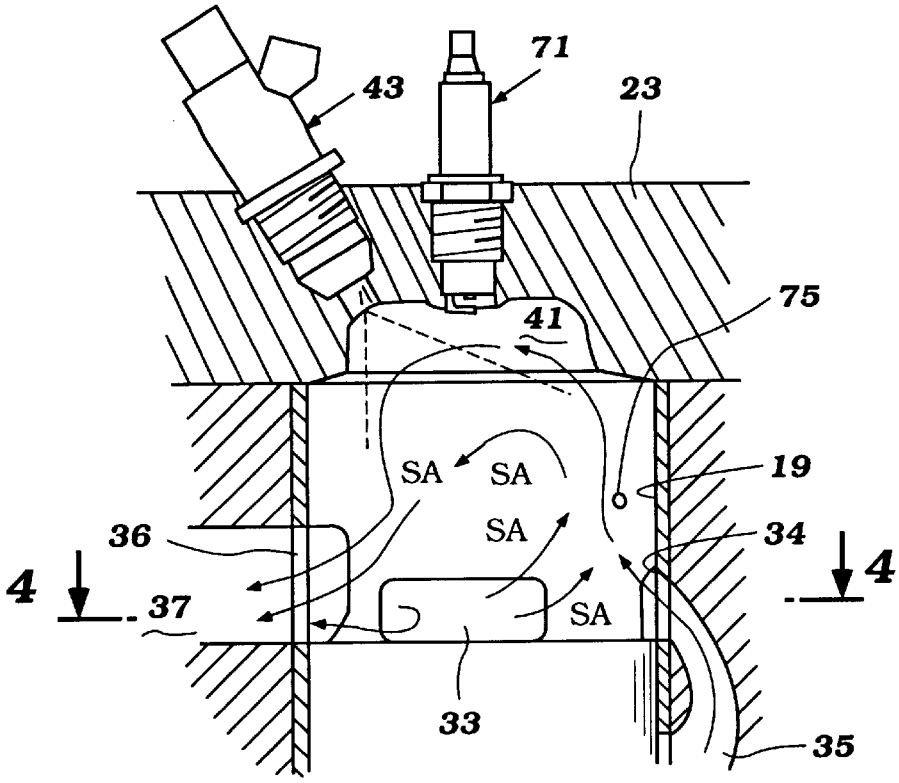
FIG. 3 is an enlarged cross-sectional view taken through a single cylinder of the engine and depicts part of the theory by which the control strategy operates.
Figure 4:
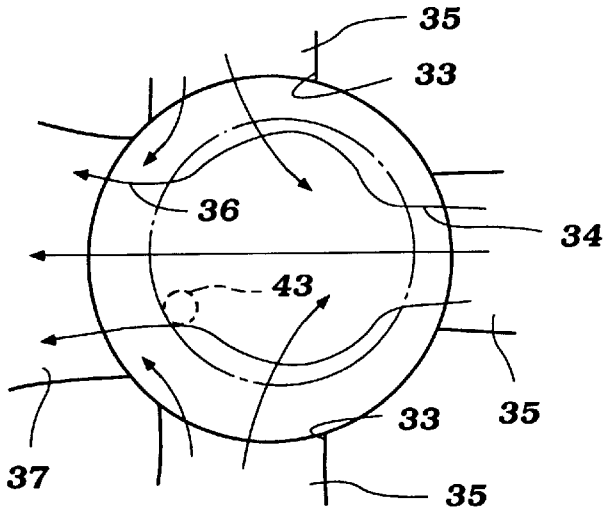
FIG. 4 is a cross-sectional view taken along the line 4—4 in FIG. 3 to further show the scavenging air flow pattern and the path of injected fuel.

Referring now additionally to FIGS. 3 and 4, it will be seen that each cylinder bore is provided with a scavenging system. In the illustrated embodiment, the scavenging system is of the Schnurl type and includes a pair of side, main scavenge ports 33 and a center, auxiliary scavenge port 34. Scavenge passages 35 communicate the crankcase chambers 25 with each of the scavenge ports 34 and 35. As is well known in two cycle practice, the scavenge ports 33 and 34 are opened and closed by the reciprocation of the pistons 21 in the cylinder bores 19.

It should be noted that the main scavenge ports 33 are disposed on opposite sides of an exhaust port 36 which is diametrically opposite the auxiliary scavenge port 34. As may be best seen in the lower left hand portion of FIG. 1 and in FIG. 2, the exhaust ports 36 communicate with exhaust manifolds 37 that are formed integrally within the cylinder block 18. Basically, there is an exhaust manifold 37 for each bank of cylinders.

These exhaust manifolds 37 terminate in exhaust pipes 38 that depend into a pair of expansion chambers 39 formed in the driveshaft housing and lower unit 16. These expansion chambers 39 communicate with a suitable high speed underwater exhaust gas discharge and a low speed, above the water exhaust gas discharge of any known type.

The underwater exhaust gas discharge is shown primarily in FIG. 2 and includes a conduit 40 that depends through the lower unit portion of the drive shaft housing lower unit and which communicates through the hub underwater discharge formed in the propeller 17.

As has been previously noted, the trim and height of the propeller 17 can be adjusted and this adjustment will change the depth of submersion of the underwater discharge during engine running. In addition, various water conditions may also cause this height to vary during engine running. Thus, the back pressure on the exhaust system will be variable and this back pressure is particularly significant in effecting the rate of air flow in scavenging the combustion chambers of the engine. Thus, a condition is present with marine applications that is not existent normally in automotive applications and which can seriously effect the feedback control.

As the pistons 21 move downwardly in their cylinder bores 19 toward the bottom dead center position as shown in FIG. 3, the charge compressed in the crankcase chambers 25 will be compressed and eventually transfer to the respective engine combustion chamber, indicated generally by the reference numeral 41 through the scavenge passages 35 and scavenge ports 33 and 34 when they are opened by the movement of the piston 21. The flow of scavenging air is shown in FIGS. 3 and 4 by the arrows SA.

In accordance with an important feature of the invention, the engine 13 is provided with a direct cylinder fuel injection system. This fuel injection system is shown in part schematically in the upper portion of FIG. 1 and will now be described by particular reference to that figure. Before referring thereto, however, it should be noted that fuel injectors 43 are mounted in the cylinder head assembly 23 so as to spray fuel from this fuel supply system directly into the combustion chambers 41. The location and functioning of these fuel injectors 43 will be described after the system which supplies fuel to them has been described.

As is typical with outboard motor practice, the outboard motor 11 is supplied with fuel from a main fuel tank 44 which is normally mounted within the hull of the associated watercraft. Fuel is supplied form this tank 44 by a first low pressure pump 45 to a fuel filter 46 that is mounted within the protective cowling 12. The connection from the fuel tank 44 to the filter 46 includes a conduit 47 having a quick disconnect coupling of a known type.

A second, engine driven low pressure fuel pump 47 in the power head 12 collects the fuel from the fuel filter 46 and delivers it to a vapor separator, indicated generally by the reference numeral 49. The low pressure fuel pumps 48 may be of the type that are operated by crankcase pressure variations as is well known in this art.

The vapor separator 49 includes an outer housing 51 that is mounted at a suitable location within the protective cowling 15. A level of fuel, indicated at 52 is maintained in this housing 51 by a valve operated by a float 53.

Contained within the housing 51 is an electrically driven pressure pump 54 which develops a higher pressure than the pump 47 but a pressure that is not really high enough for effective high pressure direct cylinder injection.

This fuel is discharged from the vapor separator housing 51 through a supply conduit 55 to a high pressure, engine driven, positive displacement pump 56. The pump 56 may be of any known type and preferably has one or more plungers operated by cams for delivering extremely high pressures at a positive displacement. The pressure at which fuel is delivered to the high pressure pump 56 is regulated by a low pressure regulator 57 in a return line 58 that communicates the pressure line 55 back with the interior of the vapor separator body 51.

The high pressure pump 56 delivers fuel under pressure to a main fuel manifold 59 through a conduit in which a check valve 61 is positioned. A parallel conduit 62 extends around the high pressure pump 56 to the main fuel manifold. A check valve 63 is provided in this bypass line so that when the high pressure pump 56 is generating high pressure fluid, no flow will occur through the line 62.

A high pressure regulator 64 is provided in the main fuel manifold 59 and limits the maximum pressure of the fuel supply to the fuel injectors 43. This is done by dumping fuel back to the vapor separator assembly 49 through a return line 65. A fuel heat exchanger or cooler 66 may be provided in this return line 65 so as to ensure that the fuel is not at too high a temperature.

A pressure sensing device 67 is provided also in the main fuel manifold 59 for providing a fuel pressure signal to an ECU, indicated at 68 in FIG. 1 for controlling the engine systems, as will be described.

The main fuel manifold 59 supplies fuel to a pair of fuel rails 69 each of which is associated with a respective one of the cylinder banks. The fuel rails 69 each supply fuel in a known manner to the fuel injectors 43 of the respective cylinder banks.

As seen in FIGS. 3 and 4, the fuel injectors 43 are mounted in the cylinder head assemblies 23, in the illustrated embodiment, over the exhaust ports 36 on the exhaust side of the engine. These injectors spray downwardly toward the heads of the pistons 21. The fuel injectors 43 are preferably of the solenoid operated type and have a solenoid valve which, when opened, controls the discharge of fuel into the combustion chambers as shown in broken lines in FIG. 3 so as to provide a fuel patch in the combustion chamber, the size of which depends upon the duration of fuel injection as will become apparent.

Spark plugs 71 are mounted in the cylinder head assemblies 23 and have their spark gaps disposed substantially on the axis of the cylinder bores 19. These spark plugs 71 are fired by an ignition circuit under the control of the ECU 68.

The ECU 68 controls the timing of firing of the spark plugs 71 and the beginning and duration of fuel injection by the injector 69. To this end, there is provided a number of sensors which sense either engine running conditions, ambient conditions or conditions of the outboard motor 11 that will effect engine performance. Certain of the sensors are shown schematically in FIG. 1 and will be described by reference to that figure. It should be readily apparent to those skilled in the art, however, that other types of sensing and control arrangements may be provided operating within the general parameters which will be set forth later having to do with the timing of initiation of fuel injection.

A crank angle sensor 72 is associated with the crankshaft 14. This sensor 72 provides not only a signal of crank angle but by comparing that signal with time an indication of crankshaft rotational speed.

There is also provided a crankcase pressure sensor 73 which senses the pressure in one or all of the crankcase chambers 25. By measuring crankcase pressure at a particular crank angle, engine air induction amount can be determined.

Engine or operator demand is determined by a throttle position sensor 74 that operates in conjunction with a throttle valve 28 so as to determine this function.

The ECU 68 operates on a feedback control condition and thus, an air fuel ratio sensor 75 is provided that communicates with the combustion chambers or exhaust port of at least one of the cylinder. Preferably, an oxygen sensor is utilized for this purpose, although other types of devices may be employed.

In order to provide a good indication of the fuel/air ratio, it is important that the oxygen sensor 75 is positioned so that it will sense the combustion products near the completion of combustion and before a fresh charge of air is delivered to the combustion chamber. Therefore, and as best shown in FIG. 3, the oxygen sensor 75 is provided so that its probe opens into the cylinder bore 19 at a point that is disposed slightly vertically above the upper edge of the exhaust port 36. In this way, the oxygen sensor 75 will be in a position to receive combustion products immediately before opening of the exhaust port and most positively before the opening of the scavenge ports so that it will sense the combustion products at the time combustion has been substantially completed. However, this places the oxygen sensor 75 in a position where fuel from the fuel injector may reach it and thus its sensitivity may be directly effected. This is compensated for in a manner which will be described later.

Engine temperature is sensed by a engine temperature sensor 76.

The temperature of the cooling water drawn from the body of water in which the watercraft or outboard motor 11 is operated is measured by a water temperature sensor 77. As has been noted, those sensors described may be just typical of any of the wide variety of sensors utilized for engine control.

In addition to controlling timing of firing of the spark plugs 71 and initiation and duration of fuel injection by the fuel injectors 43, the ECU 68 may also control a lubricating system. This is comprised of an oil supply system including a pump 78 that sprays oil into the intake passages 29 for engine lubrication. In addition, some forms of direct lubrication may be also employed for delivering lubricant directly to certain components of the engine.

It has already been noted that the adjustment of the angle of the propeller 17 will change the vertical position of its high-speed exhaust discharge and accordingly the back pressure. Thus, there are provided additional sensors which sense factors that will indicate this depth. These comprise an engine height sensor 79 that is mounted on the outboard motor 11 and which senses its height adjustment. Also, a trim angle sensor 81 is provided which senses the adjusted trim angle.

Other sensors may also be employed for control and some of these are associated with the engine 13 or the outboard motor 11 itself. These may include an engine vibration or knock sensor 82 and a neutral sensor 83. The neutral sensor 83 cooperates with the aforenoted forward, neutral, reverse transmission and will provide an indication of when the watercraft is operating in neutral.

Also shown schematically in FIG. 1 is a watercraft speed sensor 84 and a watercraft pitch sensor 85 that will sense the condition of the watercraft relative to the body of water and again indirectly the back pressure in the exhaust system. There is provided an atmospheric pressure sensor 86.

Because of the importance of the exhaust back pressure, as already noted, there is also provided an exhaust back pressure sensor 87 in one of the exhaust manifolds 37.

Of course, the sensors described are only typical of those types of sensors which may be employed for the invention, as will become apparent.

The components of the system as thus far described may be considered to be conventional and for that reason, where any component has not been illustrated or described in detail, reference may be had to conventional or known structures with which to practice the invention. The invention deals primarily with the timing of beginning of fuel injection and also the duration of injection particularly to control engine knocking. This may be understood by first referring to the timing diagram shown in FIG. 5.

Figure 5:
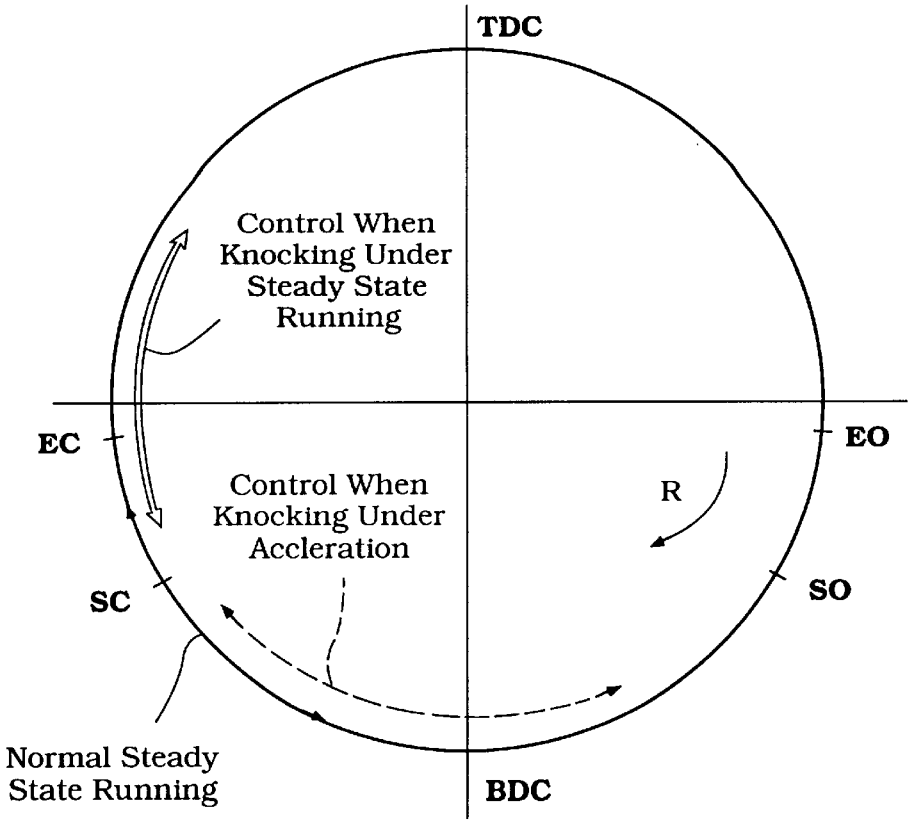
FIG. 5 is a timing diagram showing the fuel injection strategy in accordance with the invention in relation to crank angle and also the prior art type of strategy.

The direction of crankshaft rotation is indicated by the arrow R and the piston top dead center position, as shown in FIG. 5, is indicated at TDC. Bottom dead center position is indicated in FIG. 5 as BDC. This figure also shows the timing of opening of the scavenge and exhaust ports and their respective closing. The opening of the exhaust ports 36 occurs when the piston passes the upper edge of the exhaust port 36. This point is indicated as EO in FIG. 5.

As the pistons 21 continue their downward movement eventually the scavenge ports will open when their upper edges are opened by the downward movement of the pistons 21. This point appears in FIG. 5 as SO.

The scavenging operation continues when the piston 21 passes bottom dead center and begins to move upwardly to begin to close the scavenge ports 33 and 34 by passing their lower edges. Full closure of the scavenge ports occurs at the point SC in FIG. 5 when the piston again passes the upper edge of the scavenge ports 33 and 34.

Finally, the exhaust ports 36 are closed when the pistons 21 pass their upper edges 78 at the point EC.

With conventional engine injection strategies, the fuel injection is begun generally almost immediately after the exhaust ports 36 are closed with the duration being determined by the load on the engine.

In accordance with the invention described in our aforenoted, copending application, the injection timing is initiated before a point where the injected fuel path toward the exhaust port 36 and considering the air flow within the combustion chamber will not reach the exhaust port before it has fully closed. This concept is described in full detail in our aforenoted, copending application. Since this invention relates primarily to control under certain specific running conditions, a full description of the basic control strategy is not believed necessary to understand or practice this invention.

However, in accordance with the invention, the fuel injection is initiated at a time after bottom dead center and before exhaust port closing and continuing to a point before the exhaust port closes. The actual time of starting of injection and the duration are controlled by a feedback control and certain portions of that routine will now be described.

Figure 6:
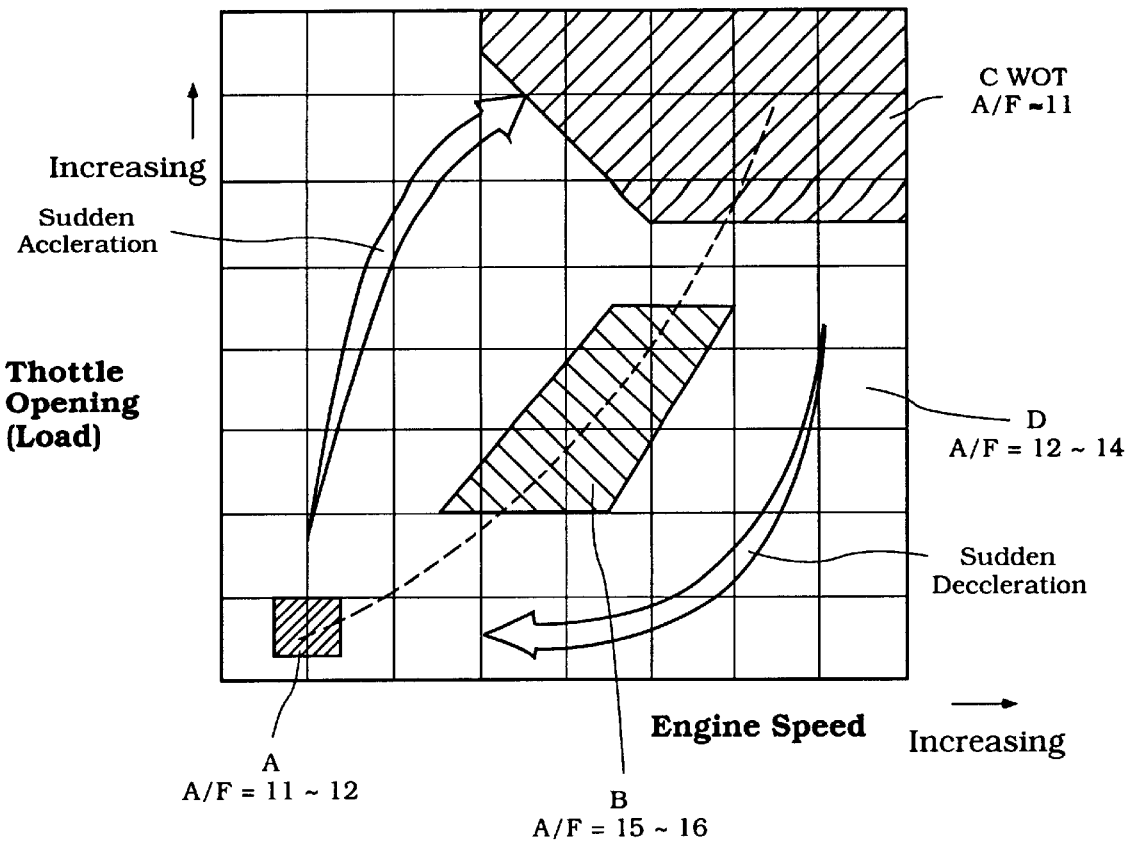
FIG. 6 is a map that shows the different control ranges that are employed in conjunction with the invention.

The various operating ranges are shown in FIG. 6. FIG. 6 is a graphical view showing the determinations that are made in the ECU 68 to determine the engine operational range. Under light loads and speeds the mixture is kept rich and the air/fuel ratio is set so as to be in the range of about 11 to 12 to 1. This range is indicated by the reference character A.

In midrange conditions there is a control range indicated at B where the engine is operated in a lean burn condition and the mixture may be somewhat stratified. This range is indicated by the reference character B and in this range the air/fuel ratio is maintained in the range of about 15 to 16 to 1.

Under high load/high speed conditions which approaches wide open throttle, there is a third control range indicated at C where the mixture is run on the excessively rich side to protect the engine from damage. In this range, the air to fuel ratio is maintained about 11 to 1.

There is a remaining range outside of those noted which is indicated at D and in this range the mixture is kept on the weak side of rich, i.e., around 12 to 14 to 1.

There are also two other types of conditions which are indicated by the open arrows one of which represents sudden acceleration and the other of which indicates sudden deceleration.

Figure 7:
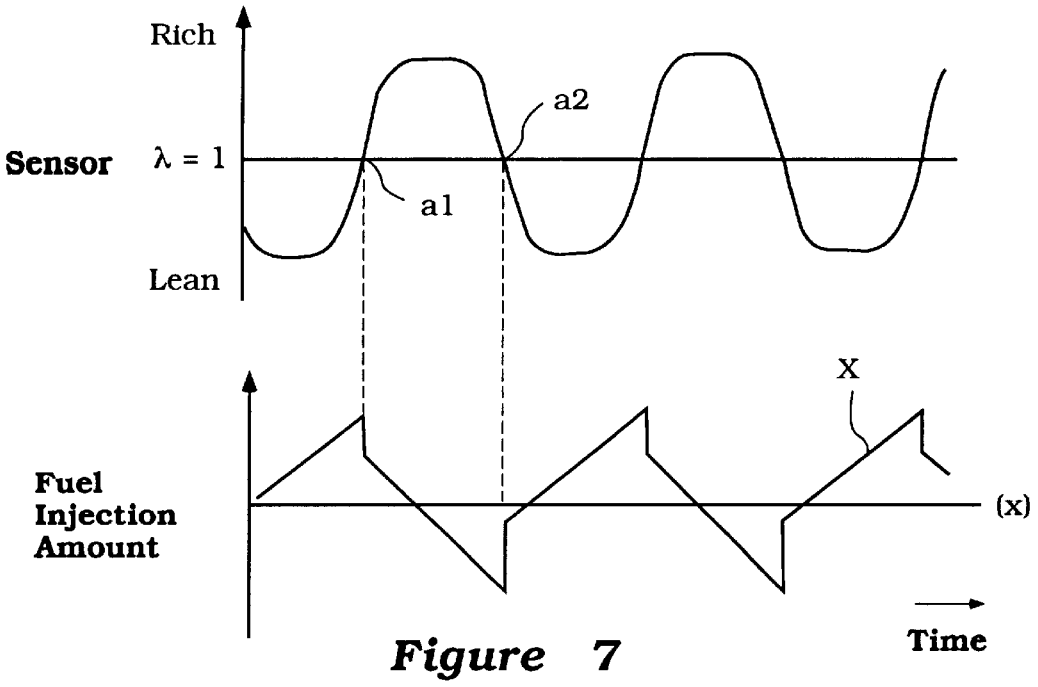
FIG. 7 is a graphical view showing the sensor output and change in the injection of fuel in the feed back control routine.

In each of the feedback control ranges, A–D, a routine as shown in FIG. 7 is followed. The upper portion of this figure shows the output of the oxygen sensor 75. As may be seen, the sensor output varies on either side of stoichiometric by going successively from lean to rich. When the mixture crosses over from lean to rich as shown at the time A1, the fuel injection amount shown in curve B is decreased. In a typical feedback control routine, an initial relatively large incremental fuel decrease occurs and subsequently lesser amounts of fuel are supplied at progressive time intervals until at the time a2 the sensor output shifts from rich back to lean. The program then moves to increase the amount of fuel injected first in a large step and subsequently in incremental steps so that the amount of fuel injected X varies again to bring the mixture back into the stoichiometric ratio.

Figure 8:
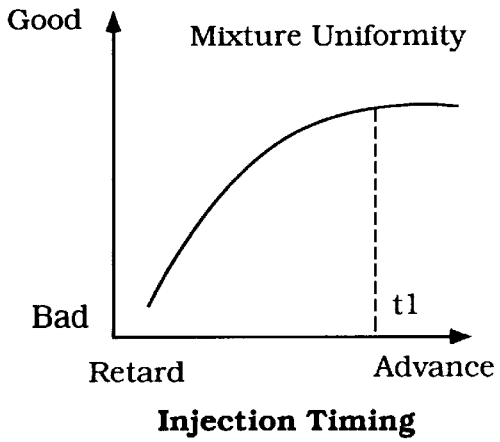
FIG. 8 is a graphical view showing how injection initiation timing will affect the uniformity of the air fuel mixture in the combustion chamber.

Aside from this description, the normal control routine may be of any type and those skilled in the art can readily understand it. However, there is another condition which is not illustrated but which is caused by what is called knocking. This is a form of pre-ignition when the fuel ignites before the spark plug has fired. This generally is a local condition and can result from two factors. One of these factors is shown in FIG. 8 and this is the mixture uniformity. As may be seen, if injection timing is retarded, the mixture does not have adequate time to mix and thus there may not be an even fuel/air mixture in the fuel patch that is going to be ignited. When this occurs, pre-ignition may result. As may be seen by advancing the ignition injection timing to the point T1, mixture distribution can be made good and this will cause the mixture to be more uniform because it has more time to disburse in the combustion chamber.

Figure 9:
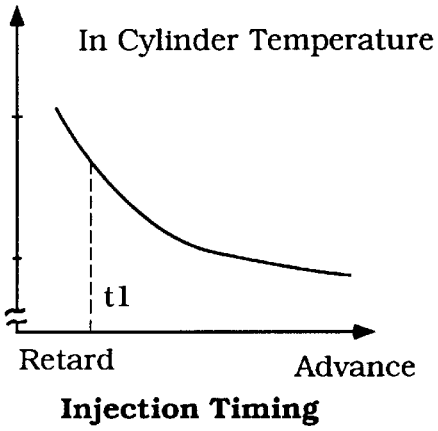
FIG. 9 is a graphical view showing temperature in the combustion chamber at the time of injection initiation.

Also, as seen in FIG. 9, the temperature in the cylinder falls as a result of the evaporation of the advanced fuel injection and this also reduces the tendency for knocking to occur under high load conditions.

In accordance with the invention, therefore, the injection timing is adjusted under some conditions to avoid knocking. Under other conditions, such as under extreme load, knocking can be best avoided by increasing the amount of fuel injected and not necessarily just the timing change. Therefore, in accordance with an important feature of the invention, the system operates so as to sense when knocking is occurring or is about to occur and also checking to see what type of running condition is happening that causes the knocking to occur. Then the appropriate type of adjustment may be made.

Figure 10:
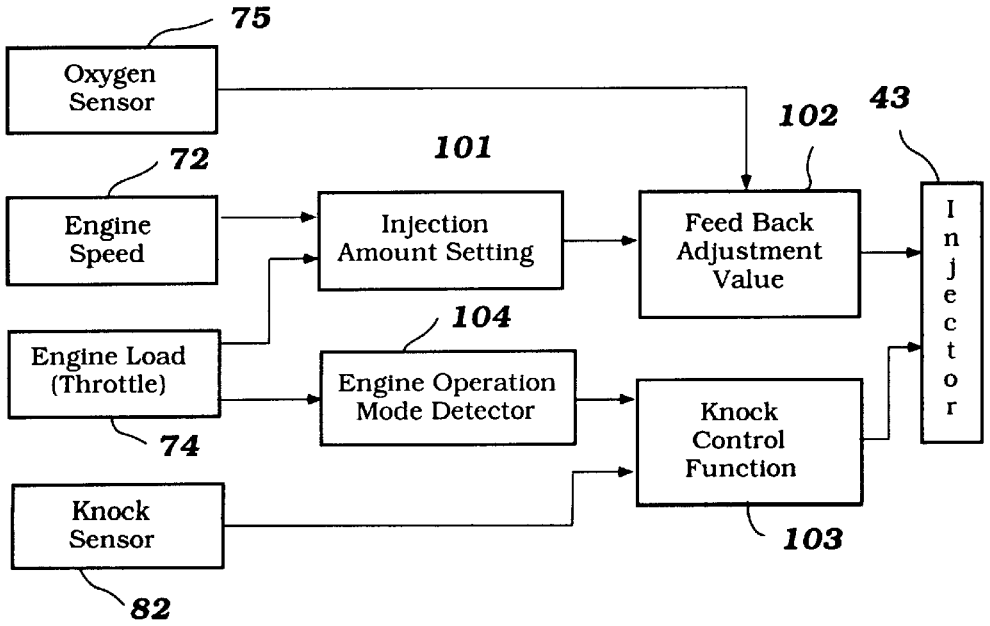
FIG. 10 is a partially schematic view showing the interrelationship between the various components of the control system.

FIG. 10 is a block diagram that shows certain portions of the ECU 68 and its association with various sensors so as to indicate how the fuel injectors 43 are controlled to provide the normal basic control and also how to avoid knocking.

Referring specifically to FIG. 10, it will be seen that the engine speed and engine load are output to an injection amount setting device 101 of the ECU 68. The speed and load readings are given from the outputs of the crankshaft position sensor 72 and the throttle position sensor 74 as aforenoted. The injection setting device 101 then outputs its signal to a feedback control section 102. This section receives the air/fuel ratio signal from the oxygen sensor 75 and makes feedback adjustments in accordance with the manner already described.

However, in addition the knock sensor 82 outputs a signal to a section 103 of the ECU which is the knock control function. This section 103 also receives an input signal by an engine operation judging means 104 which, in turn, receives a signal from the throttle position sensor 74. The operation judgment means 104 compares throttle positions with settings so as to determine if the engine is operating in a steady state condition, i.e., one in which the throttle position is not being changed rapidly with time or if it is in a rapid acceleration mode. Under this latter condition, the throttle position sensor output will be changing rapidly.

Figure 11:
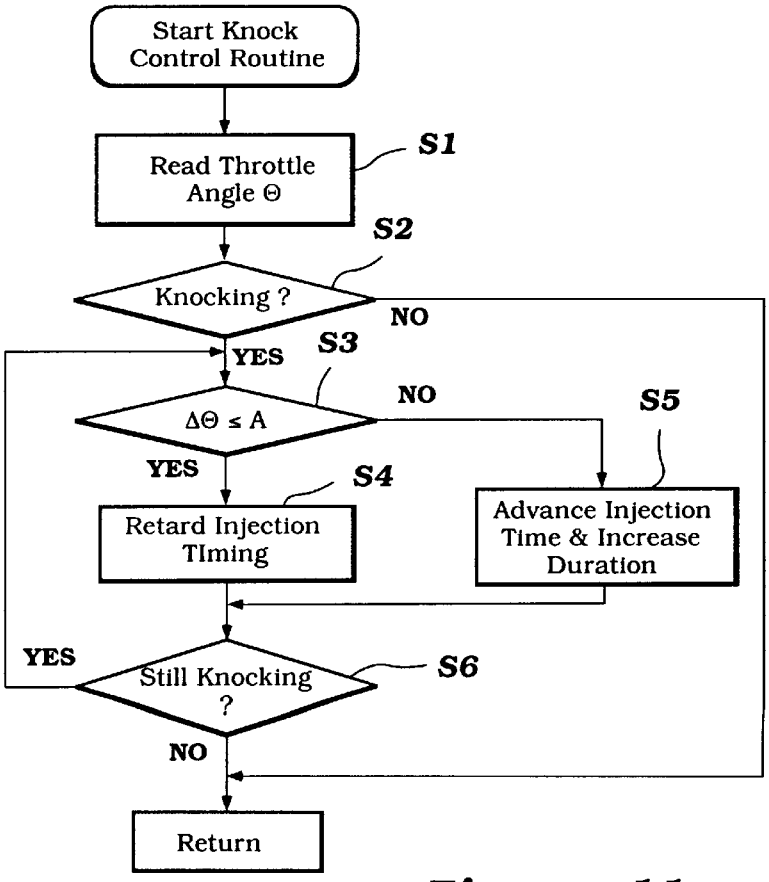
FIG. 11 is a graphical view showing the control routine in accordance with the invention.

The control routine by which this is done may be understood by reference to FIG. 11. This shows the start of the knocking prevention control routine and moves to the step S1. At this step, the throttle opening angle $\theta$ is sensed by the sensor 74. At the same time, a timer is started to run. The program then moves to the step S2 to read the output from the knock sensor. If the output from the knock sensor indicates there is no knocking, the program jumps ahead and returns.

If, however, there is knocking determined at the step S2, the program moves to the step S3 so as to determine the acceleration state. This is done by determining if the change in throttle angle in a given time period is greater than a certain value, i.e., $\Delta\theta$ is less than or equal to A.

If a lack of acceleration is determined at the step S3, it is assumed that there is steady state running and the program moves to the step S4. In this condition, knocking is prevented by retarding the initiation of fuel injection as seen in FIG. 5. By retarding the time of fuel injection, knocking has been found to be reduced.

If, however, at the step S3 it is determined that the change in throttle setting has been greater than the amount A, then it is assumed that there is an extreme acceleration and the program moves to the step S5. At the step S5, the injection timing is advanced and the duration is increased as shown in the dotted line arrow portion of FIG. 5. This gives the fuel more time to disperse but will also add sufficient fuel so as to reduce temperature and eliminate knocking. At the completion of the step S4 and S5, the program moves to the step S6 to determine if the knocking has been terminated. If it has, the program repeats. If it has not, on the other hand, the program jumps back to the step S3 and will continue to make adjustments of the appropriate type until the knocking is brought under control.

The embodiments thus far described are all in connection with a two cycle engine. As mentioned earlier, however, the invention also can be utilized with four-cycle engines and such engine embodiment is shown in FIG. 12. The illustrated embodiment is of a V6 twin overhead cam shaft engine. The overhead cam shaft mechanism appears in this figure and is identified generally by the reference numeral 201. Since the invention can be practiced with any type of conventional four-cycle engine as well as any type of two cycle engine, further description of this embodiment is not believed to be necessary to permit those skilled in the art to practice the invention. Also, since primarily the same parameters are measured, the same sensor arrangements have also been illustrated in this figure. In view of the foregoing description, however, it is believed unnecessary to fully describe this embodiment since it is believed that those skilled in the art will literally understand how the invention can be practice with four-cycle engines as well as two cycle engines.

Thus, from the foregoing description it should be readily apparent that the injection control strategy described is very effective in providing good engine combustion and eliminate engine knocking in the appropriate manner for the specific engine running condition under which the knocking occurred. Of course, the foregoing description is that of preferred embodiments of the invention and various changes and modifications may be made without departing from the spirit and scope of the invention, as defined by the appended claims.

What is claimed is:

1. A two cycle crankcase compression internal combustion engine comprised of an engine body that defines a cylinder bore, a piston reciprocating in said cylinder bore, said cylinder bore being provided with at least one scavenge port and at least one exhaust port that are opened and closed by the reciprocation of said piston, a fuel injector mounted in said engine body for injecting fuel directly into a combustion chamber formed by said piston and said engine body, means for supplying fuel under pressure to said fuel injector, means for controlling the timing of fuel injection so that the beginning of fuel injection is initiated at a time between the time period beginning when a substantially maximum injection allowable angle determined by the length of time or crankshaft rotation angle between the beginning of fuel injection and the time when the injected fuel would reach the exhaust port and terminating at the time said exhaust port closes, means for determining the existence of an engine knocking condition, and means for adjusting at least one of the fuel injection initiation time and the fuel injection duration upon the sensing of an engine knocking condition to suppress engine knocking.

2. A two cycle crankcase compression internal combustion engine as set forth in claim 1 further including means for sensing an engine running condition other than knocking and for selecting whether fuel injection initiation time or the fuel injection duration is changed to suppress engine knocking.

3. A two cycle crankcase compression internal combustion engine as set forth in claim 2 wherein the sensed engine running condition other than knocking comprises a rapid change in acceleration.

4. A two cycle crankcase compression internal combustion engine as set forth in claim 3 wherein fuel injection initiation time is retarded to suppress engine knocking when there is a rapid change in acceleration.

5. A two cycle crankcase compression internal combustion engine as set forth in claim 2 wherein the sensed engine running condition other than knocking comprises a steady state running condition.

6. A two cycle crankcase compression internal combustion engine as set forth in claim 5 wherein the fuel injection duration is changed to suppress engine knocking when there is a steady state running condition.

7. A two cycle crankcase compression internal combustion engine as set forth in claim 6 wherein the fuel injection duration is lengthened to suppress engine knocking when there is a steady state running condition.

8. A two cycle crankcase compression internal combustion engine as set forth in claim 6 wherein the fuel injection initiation time is also changed to suppress engine knocking when there is a steady state running condition.

9. A two cycle crankcase compression internal combustion engine as set forth in claim 8 wherein the fuel injection initiation time is advanced to suppress engine knocking when there is a steady state running condition.

10. A two cycle crankcase compression internal combustion engine as set forth in claim 9 wherein the sensed engine running condition other than knocking also comprises a rapid change in acceleration.

11. A two cycle crankcase compression internal combustion engine as set forth in claim 10 wherein fuel injection initiation time is retarded to suppress engine knocking when there is a rapid change in acceleration.

12. A direct cylinder injected, internal combustion engine comprised of an engine body defining at least one cylinder bore in which a piston reciprocates, a cylinder head affixed to one end of said engine body for closing said cylinder bore and defining with said piston and said cylinder bore a combustion chamber, at least one intake port for admitting an air charge to said combustion chamber, at least one exhaust port for discharging burned combustion products from said combustion chamber, a fuel injector for spraying fuel directly into said combustion chamber for combustion therein, means for sensing an engine running operation other than engine knocking, means for sensing an engine knocking condition, and means for suppressing a sensed engine knocking condition by adjusting the injection of fuel by said fuel injector, the type of fuel injection adjustment being determined by the sensed engine running condition other than engine knocking.

13. A direct cylinder injected, internal combustion engine as set forth in claim 12 wherein the fuel injection control for suppressing a sensed engine knocking condition by adjusting the injection of fuel by said fuel injector for one of the sensed engine running conditions is done primarily by adjusting only one of the timing of beginning of fuel injection and the duration of fuel injection.

14. A direct cylinder injected, internal combustion engine as set forth in claim 12 wherein the sensed engine running condition other than knocking comprises a rapid change in acceleration.

15. A direct cylinder injected, internal combustion engine as set forth in claim 13 wherein fuel injection initiation time is retarded to suppress engine knocking when there is a rapid change in acceleration.

16. A direct cylinder injected, internal combustion engine as set forth in claim 12 wherein the sensed engine running condition other than knocking comprises a steady state running condition.

17. A direct cylinder injected, internal combustion engine as set forth in claim 16 wherein the fuel injection duration is changed to suppress engine knocking when there is a steady state running condition.

18. A direct cylinder injected, internal combustion engine as set forth in claim 17 wherein the fuel injection duration is lengthened to suppress engine knocking when there is a steady state running condition.

19. A direct cylinder injected, internal combustion engine as set forth in claim 17 wherein the fuel injection initiation time is also changed to suppress engine knocking when there is a steady state running condition.

20. A direct cylinder injected, internal combustion engine as set forth in claim 19 wherein the fuel injection initiation time is advanced to suppress engine knocking when there is a steady state running condition.

21. A direct cylinder injected, internal combustion engine as set forth in claim 20 wherein the sensed engine running condition other than knocking also comprises a rapid change in acceleration.

22. A direct cylinder injected, internal combustion engine as set forth in claim 21 wherein fuel injection initiation time is retarded to suppress engine knocking when there is a rapid change in acceleration.

* * * * *